United States Patent [19]

Higgins et al.

[11] 4,189,337

[45] Feb. 19, 1980

[54] REAL TIME LABELER SYSTEM

[75] Inventors: Bobby L. Higgins, Dallas; Jerry Comer, Richardson, both of Tex.

[73] Assignee: Camsco, Inc., Richardson, Tex.

[21] Appl. No.: 895,199

[22] Filed: Apr. 10, 1978

[51] Int. Cl.[2] ..... B65C 9/18

[52] U.S. Cl. ..... 156/351; 156/356; 156/387; 156/497; 156/541; 156/584; 156/DIG. 33; 156/DIG. 45

[58] Field of Search ..... 156/249, 277, 285, 351, 156/356, 362, 384, 387, 497, 541, 540, DIG. 27, DIG. 33, DIG. 45, 321, 344, 584

[56] References Cited

U.S. PATENT DOCUMENTS

| | | | |
|---|---|---|---|
| 3,461,984 | 8/1969 | Phillips et al. | 156/367 |
| 3,729,362 | 4/1973 | French et al. | 156/541 |
| 3,736,208 | 5/1973 | Kraft et al. | 156/384 |
| 3,929,552 | 12/1975 | Bettenhausen et al. | 156/521 |
| 3,985,605 | 10/1976 | Treiber et al. | 156/384 |
| 4,028,167 | 7/1977 | Gerber | 156/384 |
| 4,082,595 | 4/1978 | Slater | 156/351 |
| 4,101,366 | 7/1978 | Teraoka et al. | 156/384 |
| 4,119,482 | 10/1978 | Bennett | 156/351 |

*Primary Examiner*—Jerome W. Massie
*Attorney, Agent, or Firm*—Richards, Harris & Medlock

[57] ABSTRACT

A real time system for writing and depositing a label on a cut piece is disclosed. The labeler is positioned relative to the cutting head of a cutting system and moves with the cutting head as a cutting operation proceeds. As the cutting takes place under the direction of the cutting system computer, a label is printed by a printer mechanism and is deposited at the appropriate time for placement on top of the cut part. Printing is by a print head having computer input and control for the indicia printed. Label depositing is effectuated by first stripping the printed label from its backing strip and holding it in place on a vacuum head. The head is lowered to a position inside the cutting head dish. At an appropriate time, the pressure is reversed such that the vacuum dissipates and a positive pressure blows the label off the head downward onto the correct part. The sticky backing on the label holds it in place on the part. The deposition may be made by direct forcing of the label toward the part or by blowing it down, thereby achieving non-contacting label deposition.

7 Claims, 5 Drawing Figures

FIG 1
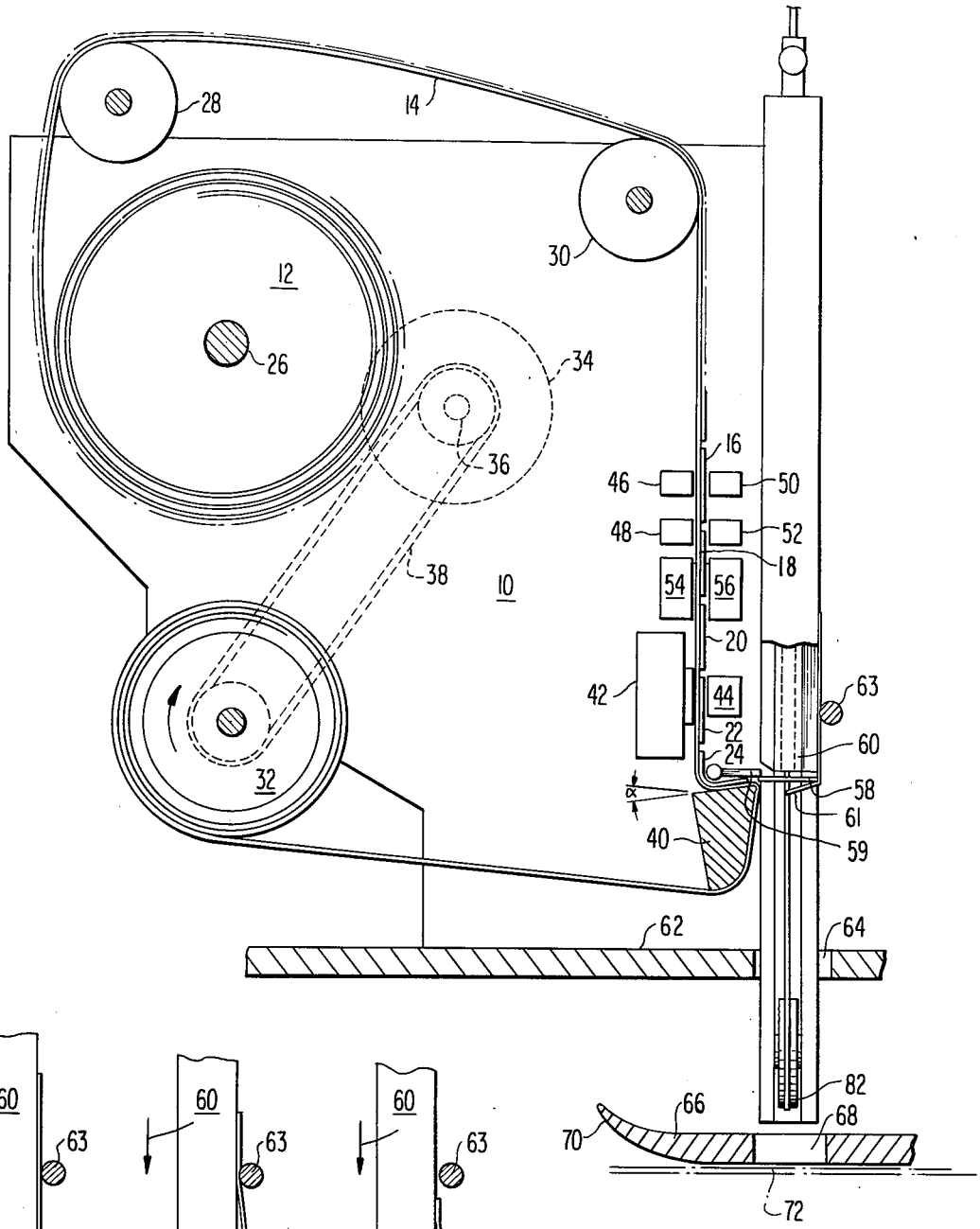
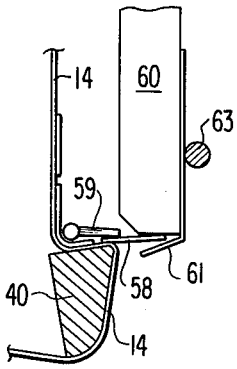
FIG 3a
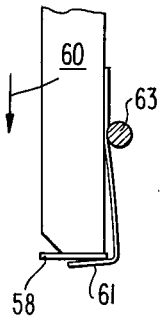
FIG 3b
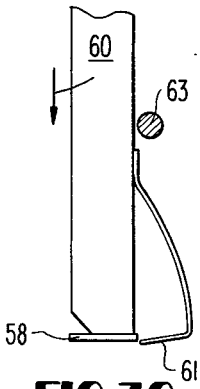
FIG 3C

REAL TIME LABELER SYSTEM

BACKGROUND OF THE INVENTION

This invention relates to a labeler subsystem used in a cutting system. Such system employs sophisticated computer control to optimize the cutting sequence for optimized cutting speed and use of materials. In one typical system, using high-pressure water as the cutting medium, the system employs at least one fluid jet cutting head, or multiple heads which traverse a cutting table by movement of a carriage in one direction and cutting head movement in an orthogonal direction. The essential structure of such a system is shown in U.S. Pat. No. 3,978,748, and a more sophisticated device in copending application Ser. No. 758,368 and now U.S. Pat. No. 4,140,038, both commonly assigned with this application. Although the labeler may be used with any computerized cutter, a preferred embodiment is in a fluid jet cutting system.

The computer receives a marker as a data input indicating the maximum utilization of material within the cutting area to minimize unused material. The marker is generally prepared in advance and supplied to the cutting system as part of the overall instructions for the cutting operation to be performed. The marker essentially fits all the pieces to be cut in such a way that for a given area, material utilization is optimized. The generation of such a marker is disclosed in U.S. Pat. No. 3,887,903. The cutter system computer uses the marker as a guide for each cut to be made, and, with sensors, determines cutting tool position on the table. The cutting sequence generally begins at one end of the cutting table and proceeds across by making cuts as indicated by the marker.

As the sequence is run, at certain points, a particular cut will finish a circumferential cut about a particular piece, thereby completely severing that piece from the raw material. The cutting head may move up or down in a particular region of the cutting table making selective cuts in correspondence with marker delineations of the arrangement of pieces. The cutting head will, accordingly, selectively traverse the cutting table and, at some point, cut pieces completely about the perimeter thereof. At that point, the affixation of labels or pieces should be ideally made. The labels identify each piece. This cutting sequence is generic to many types of movable cutters, blades, laser, fluid jet and the like. The key system interface is computer control of the cutting instrument. With the interface, labeling can take place using much of the same data with deposition being a function of cutter location on the table and the required marker data.

Unfortunately, the known technology is completely devoid of any technique which is commercially acceptable for the printing and depositing of such labels in real time and without touching the cut material. Because a given marker may be used to generate well over 100 pieces in a particular cut operation, the need for identifying labels is important and should be completed as soon as possible following cutting to preclude mishandling, misplacement, etc., of unlabeled cut pieces. Conventionally, the cut sequence is totally completed, and the entire lot of cut parts is moved to an off-load station adjacent the cutting table. Labels are then manually placed on the pieces at this station. Since computer controlled cutting can proceed at a much faster rate than the corresponding placement of labels, throughput in the system lacks peak efficiency due to disparity of speeds in the respective operations. Hence, in these prior art types of operations, the cutting sequence is effectively slowed while awaiting the task of label affixation to be completed.

Another proposed solution is to provide a cover or base sheet with labels provided thereon as the top or bottom piece of a material sheet or of a stack of plies to be cut. As the cutting operation commences, these sheets are also cut so that at the end of the operation, a cover or base piece exists for each part having thereon an identifying label for part designation. While delays in throughput at the off-load end are prevented by this technique, it is still not generally satisfactory. Delays at the front or input end of the system are encountered, and the technique is acceptable for use only with single sheets or slab goods. If cutting is to be made on raw materials off rolls or reels, it is apparent that discrete cover or base sheets are not present since the goods to be cut are continuous. Hence, in those situations where roll goods are to be cut, the technique of placement of covers cannot be used. Moreover, even in the case of slab goods, problems of alignment or relative movement exist such that the labeled pieces may slide out of position, thereby making it difficult to match cut pieces with the labeled ones.

Another proposal is to use a stylus for "writing" the label on the cut piece. However, smearing of the label, ink handling and fouling of the stylus are common problems. This technique has not proven feasible since it overly complicates operations at the point of cutting.

One prior art patent is known that describes a conceptual scheme. The patent to Gerber, U.S. Pat. No. 4,028,167, shows a basic type of labeler/cutter combination actuated by computer control. The labeler is used to print a label in real time and deposit it, or a preprinted label onto a cut bundle of pattern pieces. Gerber shows a system using a knife for cutting label segments for subsequent printing, gumming and deposition on the bundle. Deposition is by way of a solenoid operated tamper to force labels from a guide bar onto the stack. However, while such systems may appear workable, in practice, considerable problems result in the transfer of labels from the labeler mechanism to the cut pieces. These problems occur because the label itself has a sticky side which should be covered or unexposed until the last possible moment in the deposition process and the labels are small and flexible, tending to jam in the system as they are transported. There is also the requirement that the cutter be stopped in order not to have the cut piece move as a result of contact with the label applicator.

Because the labeler is positioned on a moving carriage in a confined area, size must be reduced to a minimum and reliability maximized. Techniques of gumming or otherwise applying an adhesive are unacceptable, hence, pregummed labels on a waxed backing are preferred. While a take-up spool is necessary, the corresponding lack of a fluid reservoir is an acceptable tradeoff. The entire sequencing is time crucial, with labels being printed and deposited at a speed commensurate with the cutting operation. The requirement of knife cutting to separate a label from the strip as shown in the Gerber patent introduces at least two problems. First, an additional mechanical step especially susceptible to incomplete operation is used. The shear knife may jam or not cut the label cleanly. Even if a clean cut is made, the label may be bent or have a fold, thereby causing a jam at the tamper. It may also result in incomplete gumming or on the wrong surface, thereby causing the label to stick on the guides or fail to stick on the piece.

Accordingly, research has continued to find a solution to the problem of real time label writing and deposition.

SUMMARY OF THE INVENTION

This invention proceeds from the concepts suggested in the prior art to achieve a workable efficient system. By pulling the labels through the system, the number of components to be driven is materially reduced. Also, in using labels on a backing, the backing serves as the "drive belt." The spacing of the labels allows accurate printing by sensing edge position. This is important as allowing a print operation to continue without cutting or severing the labels. The inventors have found that printing speed in the labeler can be maintained at a speed compatible with the overall computer control, if the printing is not linked to an ancillary operation.

Also, the inventors have found that a crucial point in label movement is at the transfer point. Labels tend to jam or stick because they are small and flexible. Hence, special attention is necessary to insure that flow-through occurs without jamming. Although the labeler is an important component in the cutting system, it is clearly ancillary to the cutting operation. Hence, speed and reliability must be matched to that function.

The present invention is based on dual recognitions that sufficient computing power is available to control a labeler mechanism in real time to print labels having sufficient identification data, if the mechanism positioned for movement with the cutting head for real time can accomplish real time deposition of the label on the correct part as it is cut on a repetitive basis. The invention thereby operates under direct computer control in both the writing of the label and in its placement. The labeler subsystem of a cutting system according to this invention has two basic components, the print assembly and the deposit mechanism.

The printer assembly uses a supply spool holding a roll of conventional sticky backed labels on a waxed paper backing. This backing is conventionally known as "release paper." The take-up spool is driven and pulls the backing carrying labels to a printer for printing two lines per ticket, eight characters per line of identifying data. Two sensors are used to sense label position for actuating the printing of a downstream label by the printer. Since the labels are generally equally spaced on the back-up roll, positioning for printing by sensing the edge position of an upstream label is an accurate technique for print alignment on the label. By this technique, the number of moving and/or driven components is minimized. Because the computer, as a housekeeping chore, knows exactly where the cutting head is on the table, it knows what print indicia should be placed on the label to be printed.

Lines are printed sequentially, and while the second line is being printed, a prior printed label is stripped from its backing and placed on a vacuum head for deposition. Only at this point are labels stripped from the backing. The problem of jamming due to the gummed surface contacting guides is, therefore, eliminated. The release paper is collected on the driven take-up reel. The inventors have found that the transfer point is crucial as a place of potential jamming. Receptor springs are used to guide the label onto a vacuum head which holds the printed label in place on its bottom surface and moves downward under computer control. At no time is the sticky side of the label in appreciable contact with guides or the transfer mechanism. As the cutting head completes the cut sequence for a particular piece, the vacuum head is lowered to the vicinity of the piece cut and the pressure is reversed to terminate the vacuum hold on the label and provide a positive downward pressure. This positive pressure blows the label down on the particular piece with enough force to allow the sticky back to hold the label in place. The vacuum head is maintained in its downward position some distance from the pieces cut since clearance is necessary to prevent contact with pieces already cut and labeled. The procedure continues as pieces are cut and labeled, with the printing proceeding the actual cutting of the piece.

Accordingly, it is an object of this invention to provide a novel subsystem of a cutting system for real time printing and deposition of labels without the use of separate adhesives or gumming materials.

It is another object of this invention to provide a system for the printing of labels in advance of the cutting of the part designated by the printing label and depositing the printed label in real time in a succession of iterations commensurate with computerized cutting speeds.

Yet another object of this invention is to define a method of label printing and deposition in sequence with real time cutting of a piece.

Still another object of this invention is to increase throughput in a cutting system by depositing labels without contacting the cut piece by a pusher as cutting proceeds without stopping or limiting the speed of the cutting operation.

A further object of this invention is to provide a subsystem component to a fluid jet cutting system for real time label writing and deposition.

These and other objects of this invention will become apparent from the drawings and description of the preferred embodiment that follows.

BRIEF DESCRIPTION OF THE DRAWINGS

FIG. 1 is a schematic side view of the labeler mechanism of this invention showing the print mechanism.

Figure 2:
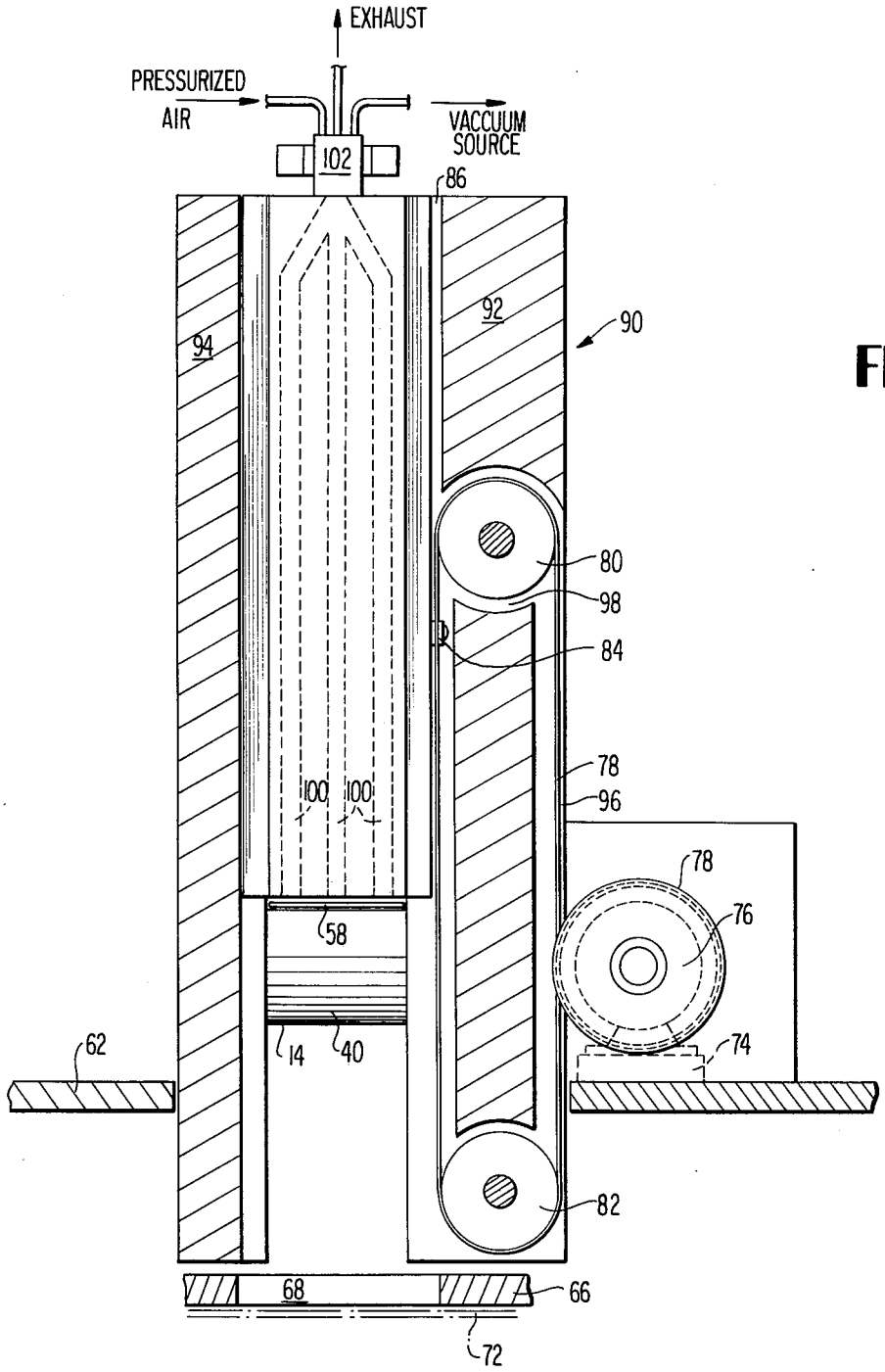
FIG. 2 is an end view of the labeler mechanism showing the vacuum head mechanism.

FIGS. *3a–3c* show the schematic operation of the slide assembly spring mechanism.

DESCRIPTION OF THE PREFERRED EMBODIMENT

Referring now to FIG. 1, a schematic side view of the labeler mechanism is shown. The labeler is generally mounted on a frame 10 and has a supply roll 12 for die-cut labels backed with a pressure-sensitive adhesive. The labels are fixed to a wax paper backing 14 and are generally packaged in a roll having several thousand lables, typically 7,000. The labels are generally evenly spaced on the backing. As will be explained later, this spacing is used to process labels in real time for printing and depositing. Shown in FIG. 1 is a typical sequence using labels 16–24 during the printing and depositing process.

The flow of labels and backing generally proceeds from roll 12 mounted on roller cradle 26 over idler rolls 28 and 30 into the printing and stripping area to be explained herein. In the stripping area, labels are separated from the release paper 14, and this paper is subsequently collected on roll 32 as it is unwound from supply 12. The roll 32 is the sole driven member in this process for moving the label supply and is driven by a label drive motor having an output shaft 36 for roller 34 driving belt 38 to rotate roll 32 in the clockwise direction shown by the arrow in FIG. 1. Hence, by driving roll 32 in the manner shown, labels are pulled from supply roll 12 through the printing and stripping area. The roll 12 is biased by a spring or other convenient technique to prevent unravelling of the labels. Also, a sensor (not shown) is provided in the form of a limit switch or the like to sense a decrease in the diameter of roll 12 to indicate a low supply of labels. Alternatively, a simple counter could be used to indicate the number of labels deposited, thereby providing a visual indication of usage.

As the labels still affixed to the release paper 14 pass over idler 30, the release paper is slightly tensioned by the pulling action of roller 32 and the frictional force associated with turning at the stripper block 40. Hence, as shown in FIG. 1, the labels generally define a straight line during passage through the print section. This section comprises a printer 42 disposed on one side of the backing 14 and an ink supply 44 disposed adjacent the label face spring biased against the label surface. The printer 42 is of a conventional design having hammers used to imprint a character on the label by pressure between the hammer foot and the label against the ink pad 44. The specific type of printer is not crucial.

The printer 42 prints one line at a time under control of the cutting system computer. That computer controls the cutting sequence by the marker program stored therein and, accordingly, knows the exact position of the cutting head on the table. Label designations—that is, the coded number identifying the part cut—are stored in the computer. When the part for a particular cut is upcoming in accordance with the marker routine, a label for the part is printed in accordance with the stored label designations. Because the cut for each part is performed in a predetermined sequence, the computer knows the order in which completion of cuts for the parts will take place. Hence, printing and subsequent deposition can proceed in the same order under computer control. The programming to command this printing and timing for proper depositing are well known and need not be detailed herein.

The alignment of labels for purposes of printing is determined by sensing upstream the position of labels to be printed. Two sets of photo-sensors are provided: sensors 46 and 48 and associated sources 50 and 52. The sensors 46 and 48 are of an optical type, sensing the transmission of light from sources 50 and 52 through a medium, in this case, the release paper backing 14. In a first position, the upper sensor 46 will sense the upper edge of a label, with a partial transmission, while the second or lower sensor 48 will be blocked entirely by the label. In this configuration, a downstream label, such as label 22, will be in position relative to printer 42 to print one line of information on the label 22. During the actual printing operation for each line, approximately 0.25 second, a brake 54 and 56 is actuated to clamp the backing 14 by, for example, pinch rollers and insure that no movement occurs downstream at the printer that would tend to blur the printed characters.

Following the printing of one line, the brake 54 and 56 is released and the label is advanced until a second position is reached as shown in FIG. 1. In the second position, the upper sensor 46 is blocked by label 16, while the lower sensor 48 senses the upper edge of the preceding label 18. In this second position, upon actuation of brake 54 and 56, a second line is printed by printer 42 and a previously imprinted label 58 is stripped from wax paper backing 14 by action of stripper block 40 and picked up by vacuum head slide 60. Thence, in the second position, the printing of the label is completed by computer control, and a previously printed label is stripped off the backing onto vacuum head slide 60 for subsequent deposit onto the appropriate cut part.

Referring now to FIGS. 2 and 3*a*–3*c*, the details of the label transfer mechanism to the vacuum head is shown. Since the labels are flexible, there is a great tendency for folding or the like that would clog or otherwise force a discontinuance of the labeling operation to clear away such labels. Hence, the need for complete transfer between stripper block 40 and slide 60 on a repetitive basis exists to insure reliability of operation. The stripper block 40 is slightly canted up at an angle $\alpha$, typically about 7°, to direct the labels upward toward the slide 60. A free-acting guide member 59 is positioned into the channel to prevent labels from bending upward. This is shown in FIG. 3*a*. Hence, by action of the stripper block 40 and guide member 59, labels are directed upward toward the slide 60 but constrained from bending into the channel between the stripper block 40 and the slide 60.

The vacuum hold action on the slide 60 may not have sufficient force to retain the label on the end until a sufficient surface of contact exists. To insure that the label is retained until the vacuum force is sufficient, spring members 61 fixed to the slide 60 are utilized to receive the label and prevent it from falling away off the face of the slide 60. Spring members 61 are formed having an elastic but deformable characteristic as shown in FIGS. 3*a*–3*c*. The spring members 61, typically two in number, are fixed to the slide 60 in any convenient manner and are biased into position by a fixed cam element 63 located in the channel between slide 60 and the housing.

As shown in FIG. 3*a*, when the slide 60 is in the upward position to receive a label 58, the cam 63 pushes the spring 61 against the side wall of the slide 60. Because of the shape of the spring 61, this action causes the lip portion to distend downward creating an opening for the label 58. As the label 58 moves toward the slide 60, the guide 59 tends to retain it, and the lip portion prevents it from falling. The slide 60 moves downward as shown in FIG. 3*b*, and with the label 58 in position, a vacuum is applied through ports 100 (FIG. 2). The spring 61 now urges the label 58 into contact so that the vacuum will hold the label on the end of the slide 60. In this second position, the cam 63, acting on an upper portion of spring 61, causes that element to assume the configuration as shown.

FIG. 3*c* shows the position of spring member 61 when the slide 60 has moved to a downward position such that cam member 63 no longer acts on spring member 61. The spring 61 is in its undeformed state positioned away from the label 58 such that deposition can take place without interference. Hence, by appropriate configuration, acting with cam 63, the spring members 61 interact with the label 58 to constrain it during one phase yet, in a completely passive manner, move away when no longer required. The cam element 63 is generally circular, having grooves (not shown) to guide the spring members 61. Position of the cam 63 relative to the spring 61 is a function of spring length and distance of travel of the slide 60. Also, while two spring members 61 have been shown to be satisfactory, any number may be used depending on label size and configuration. Also, it is preferable to provide an alignment block to strip the label 58 from the spring 61. Such a block can be placed on the slide 60 slightly protruding below the lower surface.

As shown in FIG. 1, the essential elements of the slide mechanism are shown. The frame 10 is mounted on a base plate 62 having a hole 64. The base plate 62 is mounted to the cutting head platform or other structure locking the labeler to the cutting head so that corresponding movement of the head moves the labeler. The cutting head generally has a plate member 66 disposed at the lower end thereof for purposes of smoothing the material as the head passes over it. The plate 66 is generally circular with an upturned lip 70 at the outer edge and a hole 68 for the passage of labels onto cut pieces 72. The plate 66 is useful but not essential in all types of cutting. For multiple plies, it tends to slightly compress the pile, making for more uniform cutting.

Referring now to FIG. 2, the details of the slide mechanism 60 are shown. A reversible drive motor 74 turns a drive sprocket 76 to reversibly drive a belt 78. The belt 78 is wrapped around sprocket 76 several times and around idler sprockets 80 and 82. Belt 78 has a coupling 84 to secure both free ends to the vertical slide 60 in a fixed manner. The slide 60 is housed in a housing 90, having side element 92 and 94 to constrain slide 60 to vertical motion within channel 86. Idler sprockets 80 and 82 are positioned in a portion of the housing 90 with sufficient passageways 96 and 98 for the belt 78. Hence, a direct drive is set up between motor 74 and slide 60 for up-down motion of the slide 60. It is readily apparent that other drive forms may be used, such as gears, chains and the like, so long as reciprocating motion of the slide is obtained.

The slide 60 has a series of passageways 100 used to selectively hold a label in place by vacuum or to blow it off by pressurized air. As shown in FIG. 2, passageway 100 has a valve member 102 associated to selectively gate the necessary source of vacuum or pressurized air to the passageway. In a holding mode, a vacuum source (not shown) is coupled such that by suction the label 58 is held to the bottom of the slide member 60. As the label 58 is stripped off the release paper 14 by stripper block 40, the vacuum effect in passage 100 causes the label 58 to attach to the bottom of slide 60 when properly positioned by guide 59 and spring 61. The slide 60 is then driven downward by belt 78 until it reaches an extreme downward position adjacent plate 66. This position is mechanically determined by the rotation of motor 74. Other techniques, such as sensors, trip members and the like, can also be used. When the extreme downward position is reached, the vacuum source is cut off and a pressurized air source is cut in by valve 102. Pressurized air then flows down passage 100, blowing label 58 through opening 68 onto material 72 where it sticks by nature of the tacky backing material. Once the label 58 is blown off, the compressed air is cut off and the slide is retracted by reversing motor 74 to a position adjacent stripper block 40 to receive the next label. Hence, by computer control of motor 74, selective depositing is affectuated.

Accordingly, it can be appreciated that by selective control, a label can be printed and deposited on the appropriate part in real time as the cutting operation proceeds. Throughput of the system is maintained since the tasks take place at a speed, approximately 1.5 seconds for printing and depositing, fully within the cutting speed of the system.

It is readily apparent that various modifications to this system can be made, and it can be adapted for a variety of cutters, without departing from the essential aspects of the invention.

It is also apparent that when compared with the prior art, the problems of jamming are minimized by special handling of the label at the point of stripping from the backing and transfer to the deposition mechanism.

We claim:

1. A labeler mechanism for printing and depositing labels on work pieces comprising:

a label carrier web containing a plurality of spaced apart labels;

a supply reel mounted for rotation and for receiving said label carrier web;

a take up reel mounted for rotation and for receiving said label carrier web;

said label carrier web extending from said supply reel to said take up reel for being wound on said take up reel;

a print station including means for printing at a predetermined position on said plurality of labels;

means for moving said label carrier web from said supply reel to said take up reel and to said print station;

label transfer means having an end surface and being operable between first and second positions, said first and second positions being spacially displaced from one another;

means for moving said label transfer means between said first and second positions;

stripper means having a surface for bending said label carrier web away from one of said plurality of labels to thereby partially strip one of said plurality of labels from said label carrier web and for transferring said partially stripped label to said end surface of said label transfer means in said first position;

spring means mounted to said label transfer means and being operable between first and second positions, such that when said label transfer means is in said first position, said spring means is in said first position to thereby completely remove said partially stripped label from said label carrier web and to guide said removed label toward said end surface of said label transfer means;

said spring means further maintaining said removed label in contact with said end surface of said label transfer means during movement of said label transfer means from said first position to said second position and further being operable in said spring means second position to permit said removed label to be transferred to the work piece;

cam means mounted to said label transfer means and contacting said spring means, such that as said label transfer means moves between said label transfer means first and second positions, said cam means causes said spring means to move between said spring means first and second positions;

vacuum means for generating vacuum pressure for releasably maintaining said removed label in contact with said end surface of said label transfer means; and means for applying pressurized air to said removed label in contact with said end surface of said label transfer means in said label transfer means second position to thereby transfer said label from said label transfer means to the work piece, such that said label transfer means does not contact the work pieces.

2. The mechanism of claim 1 and further including:

means for stopping movement of said label carrier web during actuation of said means for printing.

3. The mechanism of claim 1 wherein said means for printing includes:

a print head disposed adjacent said label carrier web; and means disposed adjacent said plurality of spaced apart labels for imprinting on said labels.

4. The mechanism of claim 1 and further including:

first and second sensor means positioned to alternately sense the edges and body of two adjacent labels of said plurality of spaced apart labels.

5. The mechanism of claim 1 wherein said stripper means further includes:

a free-acting guide member disposed adjacent said surface for preventing said partially stripped label from folding.

6. The mechanism of claim 1 wherein said means for moving said label transfer means between said first and second positions includes:

reversible motor means having an output shaft rotatable in first and second directions; and drive means coupled to said label transfer means and said output shaft, such that operation of said motor causes said output shaft to rotate in said first direction to thereby move said label transfer means from said first position to said second position, and such that operation of said motor causes said output shaft to rotate in said second direction to thereby move said label transfer means from said second position to said first position.

7. The mechanism of claim 1 and further including:

valve means for controlling said vacuum means and said means for applying pressurized air to thereby alternately apply said vacuum pressure and said pressurized air to said removed label in contact with said end surface of said label transfer means.

* * * * *